US011560713B2

(12) United States Patent
Cumpelík et al.

(10) Patent No.: US 11,560,713 B2
(45) Date of Patent: Jan. 24, 2023

(54) GLAZING ASSEMBLY FOR A CURTAIN WALL GLAZING SYSTEM

(71) Applicants: AGC GLASS EUROPE, Louvain-la-Neuve (BE); AGC INC., Chiyoda-Ku (JP); AGC FLAT GLASS NORTH AMERICA, INC., Alpharetta, GA (US); AGC VIDROS DO BRASIL LTDA, Sao Paulo (BR)

(72) Inventors: Pavel Cumpelík, Gosselies (BE); Razmik Balian, Chiyoda-ku (JP)

( * ) Notice: Subject to any disclaimer, the term of this patent is extended or adjusted under 35 U.S.C. 154(b) by 0 days.

(21) Appl. No.: 17/254,498

(22) PCT Filed: Jun. 20, 2019

(86) PCT No.: PCT/EP2019/066413
§ 371 (c)(1),
(2) Date: Dec. 21, 2020

(87) PCT Pub. No.: WO2020/002132
PCT Pub. Date: Jan. 2, 2020

(65) Prior Publication Data

US 2021/0123236 A1 Apr. 29, 2021

(30) Foreign Application Priority Data

Jun. 24, 2018 (EP) ..... 18179431

(51) Int. Cl.
*E04B 2/96* (2006.01)
*E06B 1/40* (2006.01)
*E06B 3/58* (2006.01)

(52) U.S. Cl.
CPC ..... *E04B 2/967* (2013.01); *E06B 1/40* (2013.01); *E06B 3/5842* (2013.01)

(58) Field of Classification Search
USPC ..... 52/204.593, 204.597, 204.595, 235, 52/506.01, 476
See application file for complete search history.

(56) References Cited

U.S. PATENT DOCUMENTS 4,672,784 A * 6/1987 Pohlar ..... E04B 2/96 52/209
4,707,959 A * 11/1987 Stoakes ..... E04B 2/965 52/235

(Continued)

FOREIGN PATENT DOCUMENTS

DE 196 30 468 C1 9/1997
EP 213521 A * 3/1987 ..... E01F 8/0017
WO WO 96/11310 A1 4/1996

OTHER PUBLICATIONS

International Search Report dated Sep. 26, 2019 in PCT/EP2019/066413 filed on Jun. 20, 2019.

*Primary Examiner* — Joshua K Ihezie
(74) *Attorney, Agent, or Firm* — Oblon, McClelland, Maier & Neustadt, L.L.P.

(57) ABSTRACT

A glazing assembly for a curtain wall glazing system comprising a glazing unit and a frame structure formed by a plurality of glazing profiles. Each of the plurality of glazing profiles comprises a main structural frame part and a removable clamping part. The removable clamping parts when removed from the structural frame parts unclamp the glazing unit and open a clearance allowing removal of the glazing unit in a direction of a first area. At least one of the main structural frame parts comprises a structural portion and a mobile clamping portion. When removing the mobile clamping portion from the structural frame portions a clearance is opened allowing the performance of maintenance activities to an edge region of the glazing unit from the second area.

19 Claims, 8 Drawing Sheets

(56) References Cited

U.S. PATENT DOCUMENTS

Figure 1:
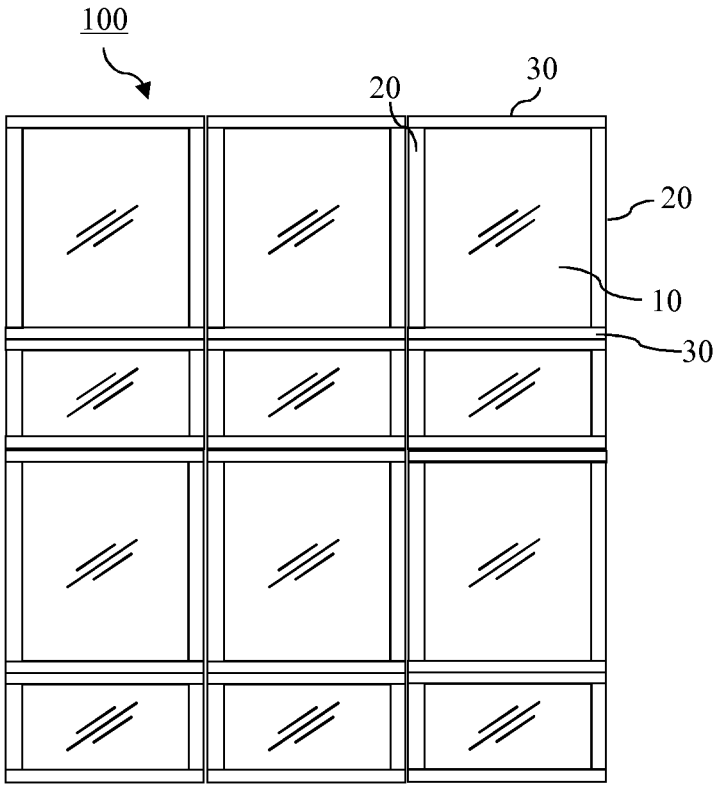

| | | | | |
|---|---|---|---|---|
| 4,756,131 | A * | 7/1988 | Stoakes | E04B 2/96 52/171.3 |
| 4,903,454 | A * | 2/1990 | Rose | E04B 2/96 52/235 |
| 5,381,637 | A * | 1/1995 | Farag | E06B 3/5427 52/204.593 |
| 5,579,616 | A * | 12/1996 | Farag | E04B 2/96 52/204.5 |
| 10,934,707 | B2 * | 3/2021 | Claeys | E04B 2/885 |
| 2007/0011974 | A1 * | 1/2007 | Ebert | E04B 2/967 52/506.01 |
| 2010/0071282 | A1 * | 3/2010 | Tofflemire | H02S 20/26 52/173.3 |
| 2013/0241299 | A1 * | 9/2013 | Snyker | H02G 3/30 307/104 |
| 2014/0311067 | A1 * | 10/2014 | Criaud | E04B 2/96 52/235 |
| 2017/0040929 | A1 * | 2/2017 | Ting | F24S 20/67 |
| 2017/0040940 | A1 * | 2/2017 | Ting | E04B 2/967 |
| 2017/0058538 | A1 * | 3/2017 | Zahner | E04B 2/967 |
| 2017/0070185 | A1 | 3/2017 | Ting | |
| 2018/0202154 | A1 * | 7/2018 | Yang | E04B 2/90 |
| 2020/0318346 | A1 * | 10/2020 | Claeys | E04B 2/965 |
| 2020/0332524 | A1 * | 10/2020 | Claeys | E04B 2/962 |
| 2021/0355679 | A1 * | 11/2021 | Newbrough | E04B 2/967 |

* cited by examiner

GLAZING ASSEMBLY FOR A CURTAIN WALL GLAZING SYSTEM

FIELD OF THE INVENTION

The present invention relates to curtain wall glazing systems. More specifically it relates to a glazing assembly comprising a plurality of glazing profiles forming a frame structure for a glazing unit of the curtain wall glazing system.

The invention also relates to curtain wall glazing systems and glazing panels using the glazing assembly according to the invention. The invention further relates to a method for performing a maintenance activity near an edge region of a first glazing unit.

DESCRIPTION OF PRIOR ART

A curtain wall glazing system is widely used as a non-structural cover for a building façade, generally for modern buildings requiring large surface glazing in order to maximize the daylight inside the building. The curtain wall glazing system also provides for an aesthetically pleasing exterior look of the building.

The curtain wall glazing system comprises glazing units and structural frames separating and supporting the glazing units. The glazing units are for example insulating glazing units (IGU's) or single glazing units or laminated glazing units. The frame of a curtain wall glazing system generally forms a grid-like structure comprising a plurality of glazing profiles. For rectangular glass panes, the glazing profiles generally correspond to a pair of mullions and a pair of transoms. The mullions are considered as the vertical glazing profiles (also named lateral glazing profile) while the transoms are considered as the horizontal glazing profiles (also named the top and bottom frame structures).

Each IGU of the curtain wall system is sealingly received by the glazing profiles and thereby supported.

The glazing profiles are typically made of aluminium or composite aluminium but they could as well be made of or partly made of natural materials such as wood or a combination of plastic and wood.

There exist various types of curtain wall glazing systems. One type is the so-called unitizing façade system. With the unitizing façade system, glazing panels or glazing modules are pre-fabricated in the factory and comprise one or more glazing units supported by the glazing profiles. Generally, each of these glazing modules has its own structural load-bearing capacity. The curtain wall is then erected on the building site and formed by placing various glazing modules next to each other and on top of each other. The glazing modules or panels are anchored to for example the concrete floor or ceiling level of the building and the panels are generally also interconnected during the erection process. These unitized façade systems are provided by various manufactures such as for example Reynaers aluminium (model CW 65-EF), Wicona (model Wictec 60) or Schuco (model USC 65).

Another type of curtain wall glazing systems are so-called stick walls where a modular framework of glazing profiles is erected on the site of construction and hence where also the IGU's are placed in the framework one by one at the construction site.

The glazing of the curtain wall glazing systems is generally a fixed glazing but provisions can also be provided to the frame that enable opening a window.

Already from the design stage of the curtain wall glazing system, an arrangement is made on how to maintain the glazing units or to replace them. For example, sensors associated to the glazing units might need maintenance, or the glazing units might need to be replaced when broken or some glazing units such as for example electrochromic IGU's (e-IGU) might need the installation or the replacement of electrical wiring or electrical components. The glazing units may comprise an electronic device preferably selected from the group consisting of electrochromic device, switchable films, such as, LCDs (liquid crystal displays), or SPDs (suspended particle devices), photovoltaic cells, and/or display. More preferably, the electronic device is one more electrochromic devices. In a particular embodiment, the electronic device comprises 2 electrochromic devices.

In the preferred embodiment wherein the electronic device is electrochromic device, such device comprises an ion conductor layer, a first electrode layer is on one side of and in contact with a first surface of ion conductor layer, and second electrode layer is on the other side of and in contact with a second surface of ion conductor layer. In addition, at least one of first and second, preferably both, electrode layers comprise electrochromic material. These layers are, in turn, arranged against the first and second substrates (5, 6). The first ion conductor layer is in electrical contact with one terminal of a power supply via a first bus bar and the second ion conductor layer is in electrical contact with the other terminal of a power supply via a second bus bar whereby the transmissivity of the electrochromic device may be changed by applying a voltage.

The peripheral gaskets positioned at the perimeter of the external surfaces of the IGU's might also need to be replaced after a number of years of use.

With the current curtain wall glazing systems, having a frame structure using a plurality of glazing profiles as discussed above, a provision is made to provide a glazing profile that comprises a main structural frame and a clamping profile that is removably attached to the main structural frame. In this way, the edge of the IGU is clamped between the structural frame and the removable clamping profile. By removing all the removable clamping profiles around the edges of the IGU, the IGU is unclamped and access is provided to remove the IGU from one side of the building or to perform maintenance activities around the edge regions of the IGU from one side of the building. For example the exterior side.

Hence, the current façade systems are designed to have access to the IGU's or replace the IGU's from one side of the building. Especially when very large IGU's are used, the IGU's can only be replaced from the outside as the removable clamping profiles are in that case on the outside while the structural frame is extending towards the inside of the building. The structural frame is designed to provide a resistance against external wind pressure.

One of the problems with the current curtain wall glazing systems using frames with glazing profiles results from the pre-determined access side determined during the design stage of the façade system. When the pre-determined access is on the outside of the building, maintenance work or replacing IGU's can be cumbersome and involve safety risks, especially for large building or for buildings where there is few room for placing cranes to lift the IGU's.

Another example where activities need to be performed to the glazing units is when a high-rise office building needs to be transformed into for example residential housing.

Further, with new glazing technologies available, such as for example e-IGU's mentioned above, a more regular maintenance program might be required with respect to installed IGU's in order to provide for the necessary upgrades of electrical components or cabling.

SUMMARY OF THE INVENTION

It is an object of the present invention to provide a glazing assembly for a curtain wall glazing system that facilitates the performance of maintenance activities to the glazing units or facilitates maintenance activities near edge regions of the glazing units. A further object of the invention is to facilitate the replacement of glazing units.

The present invention is defined in the appended independent claims. Preferred embodiments are defined in the dependent claims.

According to a first aspect of the invention, a glazing assembly for a curtain wall glazing system separating an first area from a second area is provided.

The glazing assembly comprises a first glazing unit and a plurality of glazing profiles forming a frame structure for a first glazing unit.

Each glazing profile comprises a main structural frame part and a removable clamping part that is removably coupled to the main structural frame part.

The first glazing unit is clamped between the main structural frame parts and the removable clamping parts of the plurality of glazing profiles. A first glass surface for facing the first area is linked with the removable clamping part, and a second glass surface for facing the second area is linked with the main structural frame part. The word linked has to be construed as either making a direct contact or making an indirect contact for example by placing a gasket between the first glass surface and the removable clamping part and by placing a further gasket between the second glass surface and the main structural part.

An uncoupling of the removable clamping parts from the corresponding main structural frame parts for each glazing profile, unclamps the glazing unit and opens a clearance allowing the removal of the first glazing unit in the direction of the first area.

The glazing assembly according to the invention is characterized in that at least one main structural frame part of the plurality of glazing profiles comprises a structural portion and a mobile clamping portion removably coupled to the structural portion. The removable clamping portion is linked with the second glass surface. As mentioned above, the word linked has to be construed as either making a direct contact or making an indirect contact for example by placing a gasket between the second glass surface and the mobile clamping portion.

The removal of the mobile clamping portion from the structural portion for said at least one main structural frame part, opens a clearance allowing maintenance activities to be performed near an edge region of the first glazing unit from the second area.

Advantageously, by providing, besides the removable clamping parts, also providing structural frame parts that comprise a mobile clamping portion removably coupled to a structural portion, maintenance activities in the edge region of the glazing unit not only can be performed from the first side but also from the second side. The first area is for example the outer area of a building and the second area is for example an inner area of the building.

Advantageously, when the glazing profiles comprise an inner channel enclosing specific components such as cabling and/or electric components or electronic components, by removing the mobile clamping portions a clearance is opened that allows to perform maintenance activities to these specific components. An example of such a specific component is a power source such as a battery.

Advantageously, with the glazing assembly of the invention, both peripheral gaskets can be replaced without removing the glass unit. Indeed, the first peripheral gasket can be replaced by first removing the mobile clamping portions and the second peripheral gasket can be replaced by first removing the removable clamping parts.

According a second aspect of the invention, a method for performing a maintenance activity near at least one edge region of a first glazing unit is provided, as will be outlined below in the detailed description.

SHORT DESCRIPTION OF THE DRAWINGS

Figure 2:
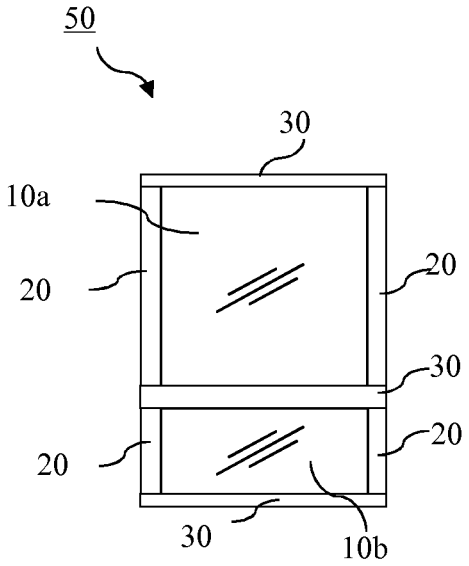
Figure 3:
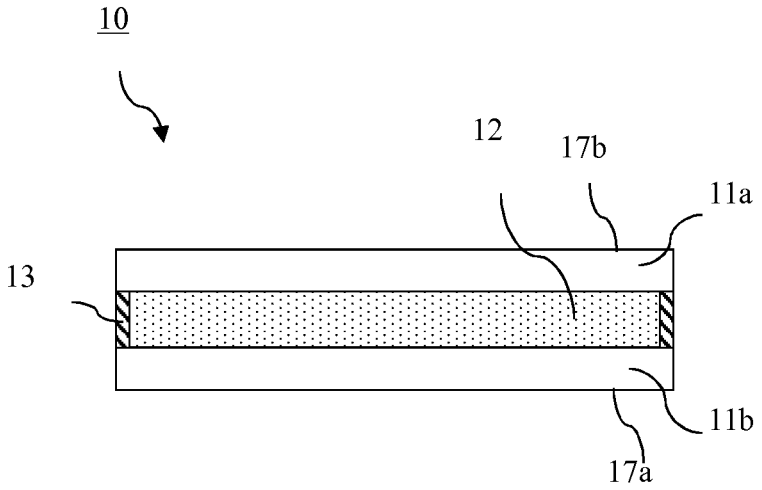
Figure 4:
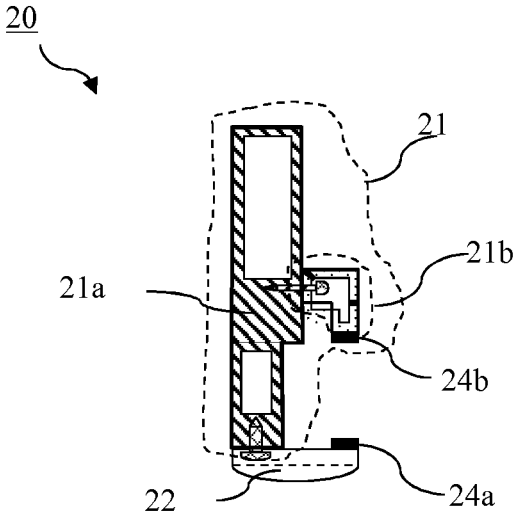
Figure 5:
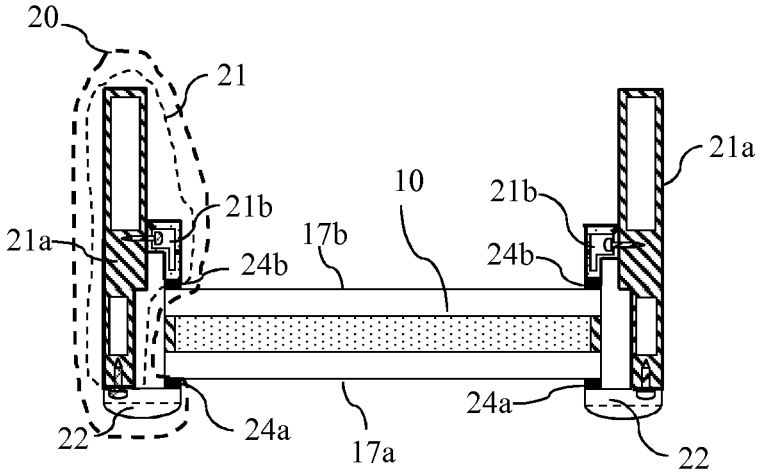
Figure 6A:
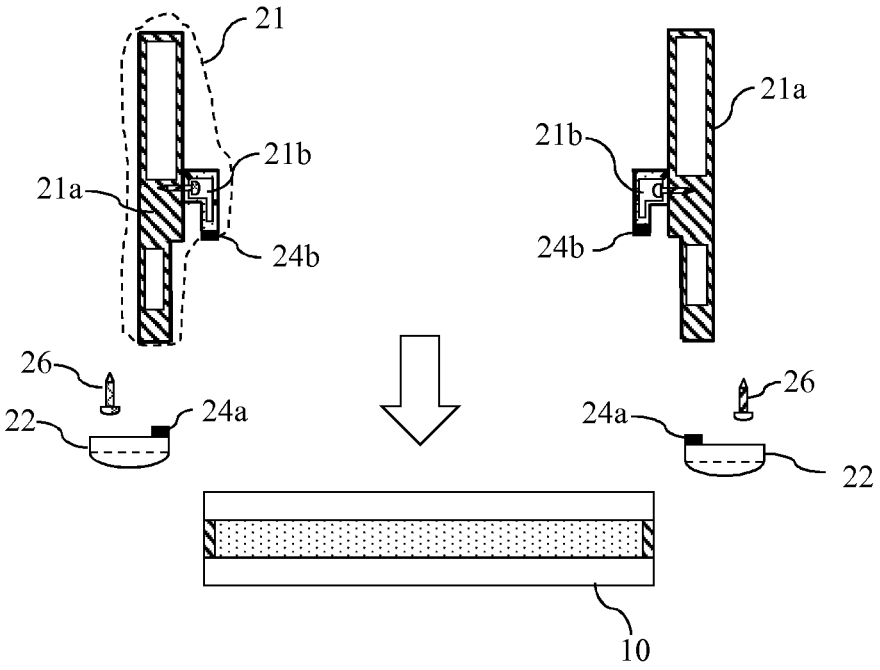
Figure 6B:
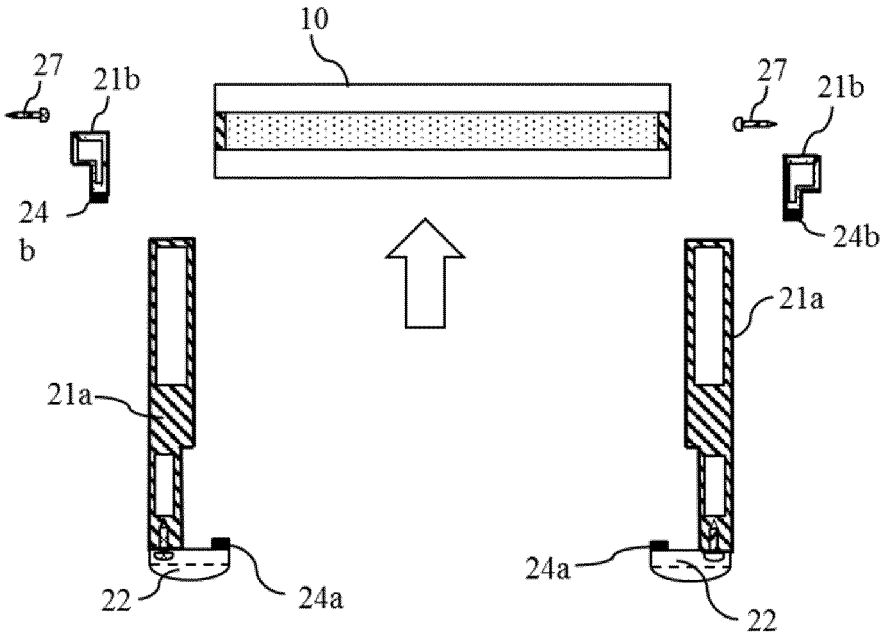
Figure 7:
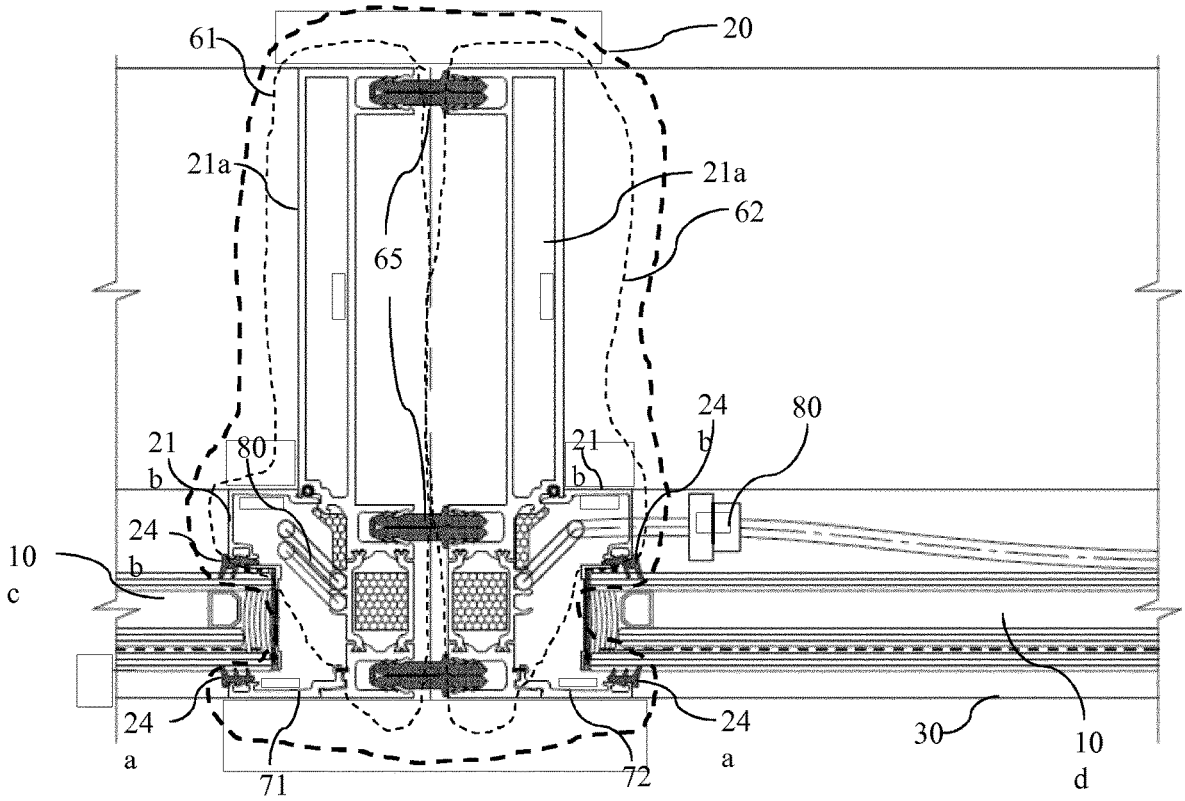
Figure 8:
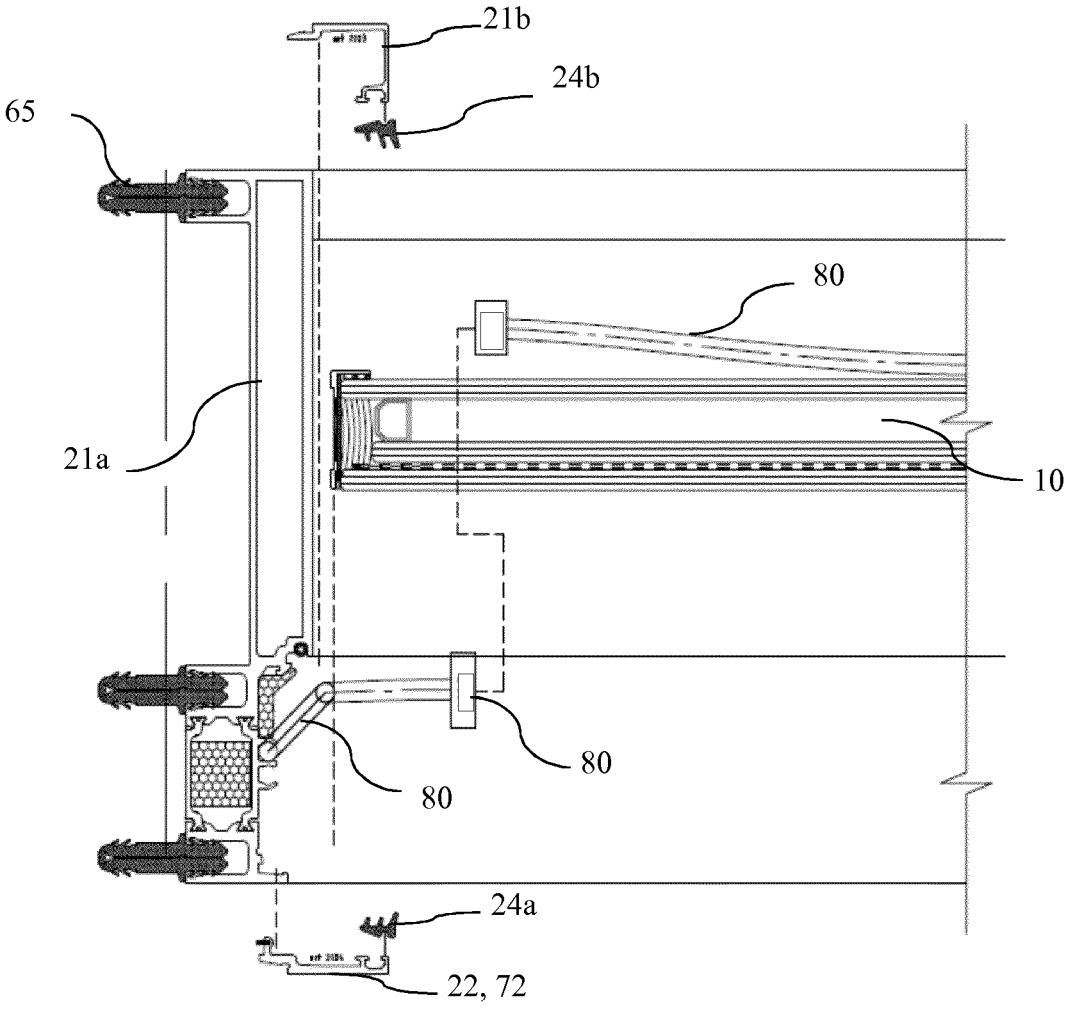
Figure 9:
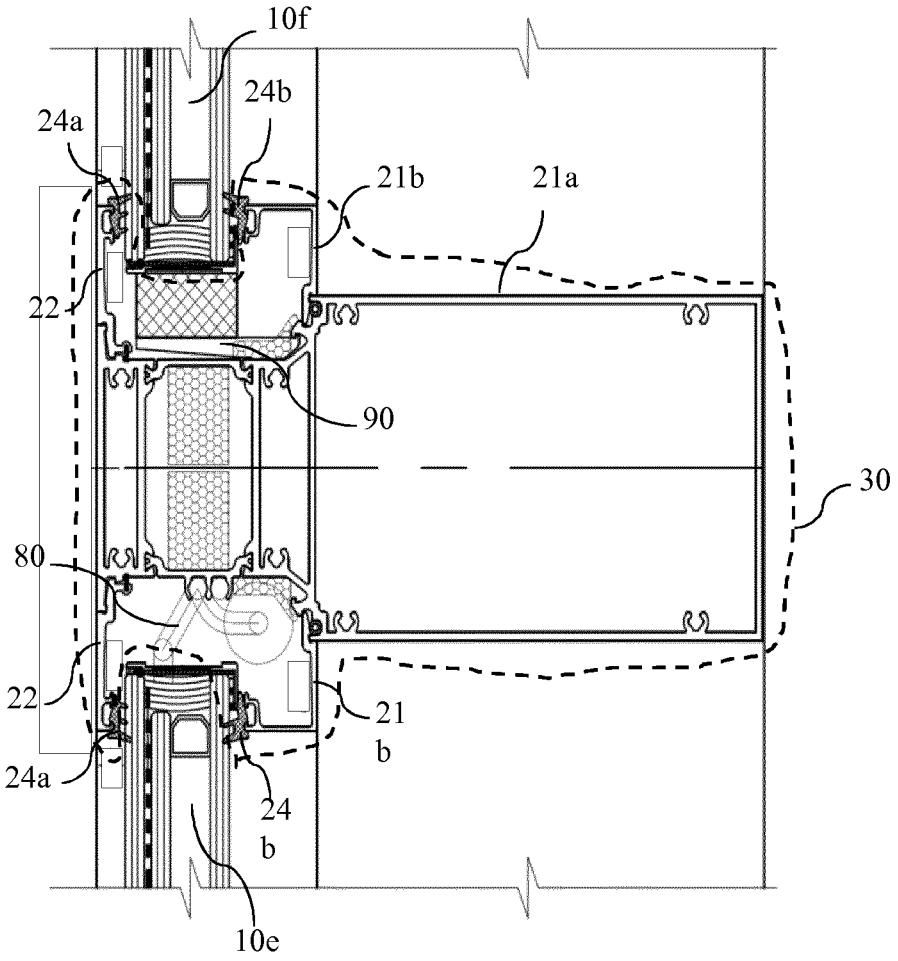
Figure 10A:
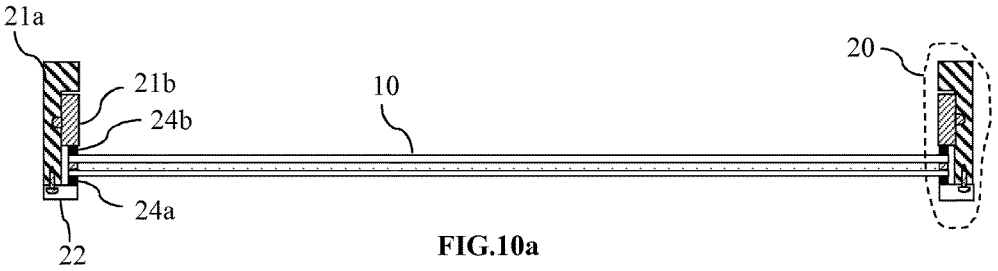
Figure 10B:
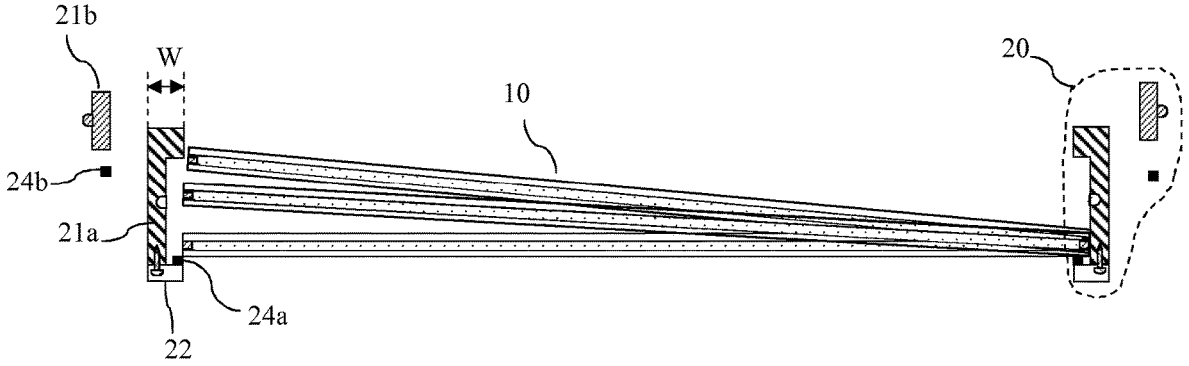

These and further aspects of the invention will be explained in greater detail by way of example and with reference to the accompanying drawings in which:

FIG. 1 schematically illustrates an example of curtain wall glazing system,

FIG. 2 schematically illustrates an example of glazing panel of a unitizing façade system, FIG. 3 schematically illustrates an example of an insulating glazing unit, FIG. 4 schematically illustrates a cross sectional view of an example of a glazing profile according to the invention, FIG. 5 schematically illustrates a cross sectional view of an example of a glazing assembly according to the invention, FIG. 6*a* schematically illustrates a removal of a glazing unit via a first area, FIG. 6*b* schematically illustrates a removal of a glazing unit via a second area, FIG. 7 shows a projection of an embodiment of a mullion profile according to the invention, FIG. 8 shows an expanded view of a part of FIG. 7, FIG. 9 shows a projection of an embodiment of a transom profile according to the invention, FIG. 10*a* shows a cross sectional view of an embodiment of glazing assembly according to the invention, FIG. 10*b* schematically illustrates the removal of the glazing unit for the glazing assembly of FIG. 10*a*.

The figures are not drawn to scale. Generally, identical components are denoted by the same reference numerals in the figures.

DETAILED DESCRIPTION OF PREFERRED EMBODIMENTS

According to a first aspect of the invention a glazing assembly for a curtain wall glazing system separating an first area from a second area is provided. The first area is for example the interior area of a building and the second area is for example the outer area of the building.

A curtain wall glazing system 100 is schematically shown on FIG. 1. The curtain wall glazing system comprises a plurality of glazing units 10. The exemplary curtain wall system shown on FIG. 1 comprises twelve glazing units. The glazing unit 10 has for example a rectangular shape and hence comprises four edges. The glazing unit 10 comprises a first glass surface facing the first area and a second glass surface facing the second area.

As discussed above, a specific embodiment of a curtain wall system, is a unitizing façade system that is composed of multiple glazing panels 50, also named glazing modules, placed adjacently and/or on top of each other. Each glazing panel can comprise one or more glazing units 10. An example of a glazing panel 50 for a unitizing façade system is schematically shown on FIG. 2. In this example, the glazing panel 50 comprises two glazing units 10*a* and 10*b*. A curtain wall glazing system 100, as shown on FIG. 1, could for example be built by combining six of the glazing panels shown on FIG. 2.

In order to build a curtain wall glazing system a glazing assembly is needed. A glazing assembly according to the invention comprises a glazing unit 10 and a plurality of glazing profiles 20,30. These glazing profiles are forming a frame structure for the glazing unit. As known in the art, the glazing profiles are surrounding the edges of the glazing unit and as a consequence of the framing of the glazing unit, the edge regions of the glazing unit or not directly accessible.

In embodiments, the glazing unit 10 is a single glazing unit, known in the art.

In other embodiments, the glazing unit 10 is an insulating glazing unit, known in the art, for example double or triple glazing. In FIG. 3, an example of a double glazing unit is schematically illustrated. In this example, the glazing unit comprises a first glass pane 11*a* and a second glass pane 11*b* separated by an edge spacer 13, thereby forming an interspace that is generally filled with an insulating gas or, alternatively, the interspace 12 is hold under vacuum.

In embodiments, the glazing unit 10 can also be an e-IGU. An e-IGU is an insulating glazing unit whose functionality is related to connected electric or electronic components. Such components can be either integrated directly into the glazing or being attached to it. Those components can for example be located in the edge region of the glazing unit, i.e. in a region adjacent to the glazing unit which is for example an inner channel in the glazing profile adjacent or in the vicinity of the edge of the glazing unit. The e-IGU's allow for example for a dynamic change of opto-energetic properties.

In further embodiments, the glazing unit 10 is a laminated glazing unit.

Each of the glazing profiles 20, 30 of the glazing assembly comprises a main structural frame part 21 and a removable clamping part 22. This is schematically illustrated on FIG. 4 where a cross sectional view of an example of a glazing profile 20 according to the invention is shown. The removable clamping part 22 is removably coupled to the main structural frame part 21 by using for example screws 26 or by using a click attachment system.

In this way, as illustrated on FIG. 5, the glazing unit 10 is clamped between the main structural frame parts 21 and the clamping profile parts 22 of the glazing profiles. As illustrated, the first glass surface 17*a* is linked with the removable clamping part 22, and the second glass surface 17*b* is linked with the main structural frame part 21.

As schematically illustrated on FIG. 6*a*, when removing the removable clamping parts 22 from the structural frame parts the glazing unit 10 is unclamped and a clearance is opened allowing to replace the glazing unit 10 in the direction of the first area. The glazing unit can be removed by generally performing a translational motion with the glazing unit in a direction normal to the first glass surface of the glazing unit. Typically, if the first area is the outer area of the building, the glazing unit is replaced by using a crane located on the outside of the building.

In embodiments, at least one main structural frame part 21 of the plurality of glazing profiles of the glazing assembly according to the invention comprises a structural portion 21*a* and a mobile clamping portion 21*b*. The mobile clamping portion 21*b* is removably coupled to the structural portion 21*a*, for example with screws 27 or bolts or with a click attachment system or with any other means suitable for performing the coupling between the clamping portion and the structural portion. The removal of the mobile clamping portion 21*b* from the structural frame portion 21*a* for the at least one main structural frame part 21, opens a clearance allowing maintenance activities to be performed near an edge region of the first glazing unit 10. In this way, the maintenance can be performed from the second area.

Performing maintenance activities near an edge region have to be construed in the broadest sense, i.e. it can be a maintenance activity on an edge of the glazing unit itself, for example cleaning or replacing a gasket that is located on the edge of the glazing unit, or it can be a maintenance activity in the vicinity of the edge, for example replacing a battery or a cable that is located in a cavity next to the edge of the glazing unit. It is the removal of the mobile clamping portion that opens the clearance to the edge region.

In preferred embodiments, each of the main structural frame parts 21 of the plurality of glazing profiles 20,30 comprises a structural portion 21*a* and a mobile clamping portion 21*b* removably coupled to the structural portion 21*a*. The mobile clamping portion is linked with the second glass surface 17*b*. Advantageously, with these preferred embodiments, by removing the mobile clamping portions form the structural portions for each glazing profile, the glazing unit 10 is unclamped. This opens a clearance allowing the removal of the glazing unit 10 in the direction of the second area. Alternatively, the clearance that is opened also allows to perform maintenance activities near edge regions of the glazing unit 10. This removal or maintenance activity can in this way, advantageously be performed from the second area.

The removal of the glazing unit 10 after removing the mobile clamping portions is schematically illustrated on FIG. 6*b*.

The glazing assembly according to the invention comprises, as illustrated on FIG. 5 and FIG. 7, a first peripheral gasket 24*a* secured between the first glass surface 17*a* and the removable clamping parts 22 of the glazing profiles.

Preferably, the glazing assembly comprises, as further illustrated on FIG. 5 and FIG. 7, a second peripheral gasket 24*b* secured between the second glass surface 17*b* and the mobile clamping portions 21*b* of the glazing profiles.

In embodiments, the glazing unit (10, 10*c*, 10*e*) has a rectangular shape. In these embodiments, a first and a second glazing profile of the plurality of glazing profiles corresponds to a pair of mullions placed in parallel and a third and a fourth glazing profile of the plurality of glazing profiles corresponds to a pair of transoms placed in parallel. As discussed above, a mullion or a transom are glazing profiles that are generally positioned in a vertical or a horizontal position, respectively.

In some embodiments where a second glazing unit is positioned adjacent to the first glazing unit, a common mullion or a common transom is shared. Such a common mullion or common transom is configured for receiving an edge of the first glazing unit and for receiving an edge of the second glazing unit, in an adjacent configuration, wherein the first and second glazing units are separated by the common mullion or common transom.

In FIG. 7, a projection of a part of an embodiment of a glazing assembly according to the invention is shown. In this example, the mullion 20 is configured for receiving two glazing units 10*c* and 10*d* in order to support two adjacently positioned glazing units of a curtain wall glazing system. The mullion 20 shown on FIG. 7 comprises two main structural frame parts, a first one 61 and a second one 62, and two removable clamping parts, a first one 71 and a second one 72. The two main structural frame parts 61, 62 are coupled together for example with bolts or screws 65 or with a click attachment system. Each of the two main structural frame parts 61, 62 comprises, as discussed above, a structural portion 21*a* and a mobile portion 21*b* removably coupled with the structural portion 21*a*.

In FIG. 8, an expanded view is shown of a part of the mullion that is shown on FIG. 7 in order to further illustrated the basic components of the glazing profile that are important for the invention. In FIG. 8 and FIG. 9, it is also illustrated that a glazing profile can comprise an inner channel enclosing cabling and/or electric or electronic components 80. Advantageously, by removing the mobile clamping portion 21*b* of the mullion or the transom, a clearance is opened allowing to have access to the inner channel for performing maintenance activities to cabling and/or electric components or electronic components. This strongly facilitates the performance of maintenance activities as a selection can be made to perform these maintenance activities from the inside of the building instead of the outside of the building.

In FIG. 9, a projection of a part of a further embodiment of a glazing assembly according to the invention is shown.

In this example the glazing assembly comprises a transom 30 that is configured for receiving two glazing units 10*e* and 10*f*, placed on top of each other. The transom comprises a single main structural frame part and two removable clamping parts 22 removable coupled to the single main structural frame part. The single main structural frame part comprises a single structural portion 21*a* and two mobile clamping portions 21*b* removably coupled with the single structural portion 21*a*. The two mobile clamping portions 21*b* coupled to the single structural portion 21*a* are indicated on FIG. 9. As known in the art, and illustrated on FIG. 9, the transom also comprises a glass pane supporting member 90 configured for supporting the glass pane 10*f*.

In embodiments, the removal of the mobile clamping portion 21*b* from the structural frame portion 21*a* for each of the main structural frame parts 21 unclamps the glazing unit and opens a clearance allowing the removal of the glazing unit in the direction of the second area by a rotation of the glazing unit about an edge thereof, or by a translation in the direction of the second area, or by a combination of rotation and translation.

In FIG. 10*a* and FIG. 10*b* an example of an embodiment of a glazing assembly wherein the glazing unit can be removed by a combination of rotation and translation is shown. In this embodiment, as illustrated on FIG. 10*b*, when removing the mobile clamping portions 21*b* from the structural frame portions 21*a*, the glazing unit is unclamped and a clearance is opened allowing to perform a rotational movement or a combination of a translation and a rotational movement of the glazing unit 10 in order to remove the glazing unit 10 from the second area. The advantage of this embodiment, when compared to the embodiment of for example shown on FIG. 5, is that the width W of the glazing profile can be kept short or very similar to the width of a glazing profile not having the mobile clamping portions.

As discussed above, the glazing profiles can, as known in the art, be made of various materials such as for example aluminium, composite aluminium, plastic, natural materials such as wood or a combination of plastic and wood.

According to a second aspect of the invention, a method for performing a maintenance activity near at least one edge region of a first glazing unit 10 of a curtain wall glazing system 100 that is separating a first area from a second area is provided. The method is applicable for a glazing system comprising a glazing assembly according to the invention as discussed above. The method comprises a step of selecting whether the maintenance activity is to be performed from the first area or form the second area. This selection is generally based on the type of maintenance that needs to be performed. For example replacing a battery located in an inner channel of a glazing profile is preferably performed from the interior side of the building. On the other hand, replacing the peripheral gasket that is facing the outside of the building, only can be replaced from the exterior side of the building.

If on the one hand, the maintenance activity is to be performed from the first area then the method comprises a step of uncoupling the clamping parts 22 from the structural frame parts 21 for one or more of the plurality of glazing profiles 20, 30. In this way, a clearance is opened to the edge region. In a further step, the maintenance activity is performed from the first area.

If on the other hand, the maintenance activity is to be performed from the second area, then the method comprises a step of removing the mobile clamping portion 21*b* from the structural portion 21*a* for at least one main structural frame part 21. This opens a clearance to the edge region. In a further step, the maintenance activity is performed from the second area.

According to a further aspect of the invention, a method for removing a first glazing unit from a curtain wall glazing system separating an first area from a second area is provided. The method is applicable for a glazing system comprising a glazing assembly according to the invention as discussed above. The method comprises a step of selecting whether the glazing unit is to be removed from the first area or form the second area. Such a selection is typically based on the size of glazing unit to be replaced, the floor level where the glazing unit is to be replaced, the availability of place outside the building to place a crane or not, the size of the elevator in the building and other parameters.

If the first glazing unit is to be removed from the first area then for each of glazing profiles, the method comprises a step of uncoupling the clamping parts 22 from the structural frame parts 21 and a step of moving the first glazing unit in a direction of the first area.

If the first glazing unit is to be removed from the second area then for each of the glazing profiles, the method comprises a step of removing the mobile clamping portions 21*b* from the structural portions 21*a* and a step of rotation the first glazing unit about an edge thereof, or translating in the direction of the second area, or by combining rotating and translating of the first glazing unit.

The present invention has been described in terms of specific embodiments, which are illustrative of the invention and not to be construed as limiting. It will be appreciated by persons skilled in the art that the present invention is not limited by what has been particularly shown and/or described above and that alternatives or modified embodiments could be developed in the light of the overall teaching of this disclosure. Use of the verb "to comprise", as well as the respective conjugations, does not exclude the presence of elements other than those stated. Use of the article "a", "an" or "the" preceding an element does not exclude the presence of a plurality of such elements.

REFERENCE SIGNS

10, 10*a*, 10*b*, 10*c*, 10*d*, 10*e*, 10*f* glazing unit
11*a* first glass pane

11*b* second glass pane
12 interspace
13 edge spacer
17*a* first glass surface
17*b* second glass surface
20, 30 glazing profile
21, 61, 62 main structural frame part
21*a* structural portion
21*b* mobile clamping portion
22, 71, 72 removable clamping part
24*a* first peripheral gasket
24*b* second peripheral gasket
26, 27, 65 screw or bolt or click attachment system
50 glazing panel
80 cabling or electric components or electronic components
90 glass pane supporting member
100 curtain wall glazing system

The invention claimed is:

1. A glazing assembly for a curtain wall glazing system separating a first area from a second area, comprising:

a first glazing unit comprising a first glass surface for facing said first area and a second glass surface for facing said second area, a plurality of glazing profiles forming a frame structure for said first glazing unit, and wherein each glazing profile comprises a main structural frame part, and a removable clamping part removably coupled to the main structural frame part by a fastener, wherein said first glazing unit is clamped between the main structural frame parts and the removable clamping parts of said plurality of glazing profiles, with the first glass surface linked with the removable clamping part, and the second glass surface linked with the main structural frame part, wherein an uncoupling of the removable clamping parts from the corresponding main structural frame parts for each glazing profile unclamps the first glazing unit and opens a clearance allowing the removal of the first glazing unit in a direction of the first area, wherein at least one main structural frame part of said plurality of glazing profiles further comprises a structural portion, and a mobile clamping portion removably coupled by a fastener to said structural portion, and linked with the second glass surface, and wherein the removal of the mobile clamping portion from the structural portion for said at least one main structural frame part, opens a clearance allowing maintenance activities to be performed near an edge region of the first glazing unit from said second area.

2. The glazing assembly according to claim 1, wherein the glazing profile that comprises said at least one main structural frame part, comprises an inner channel enclosing cabling and/or electric components or electronic components.

3. The glazing assembly according to claim 2, wherein the removal of the mobile clamping portion from the structural portion which opens the clearance allows access to said inner channel for performing maintenance activities on the cabling and/or electric components or electronic components.

4. The glazing assembly according to claim 1, wherein said mobile clamping portion is removably coupled with said structural portion using screws or bolts or a click attachment system.

5. The glazing assembly according to claim 1, wherein said first glazing unit is an insulating glazing unit or a single glazing unit or a laminated glazing unit.

6. The glazing assembly according to claim 1, wherein said first glazing unit is a fixed glazing unit.

7. The glazing assembly according to claim 1, wherein said first glazing unit has a rectangular shape and wherein a first and a second glazing profile of said plurality of glazing profiles corresponds to a pair of mullions placed in parallel and wherein a third and a fourth glazing profile of said plurality of glazing profiles corresponds to a pair of transoms placed in parallel.

8. The glazing assembly according to claim 7, comprising a second glazing unit positioned adjacent to said first glazing unit and sharing therewith a common mullion or transom, which is configured for receiving an edge of the first glazing unit and for receiving an edge of the second glazing unit in an adjacent configuration, wherein the first and second glazing units are separated by said common mullion or transom.

9. The glazing assembly for a curtain wall glazing system according to claim 1, wherein each of the main structural frame parts of said plurality of glazing profiles comprises a structural portion, and a mobile clamping portion removably coupled to said structural portion, and linked with the second glass surface, and wherein the removal of the mobile clamping portion from the structural portion for each of the main structural frame parts unclamps said first glazing unit and opens a clearance allowing the removal of said first glazing unit in a direction of the second area and/or allows maintenance activities to be performed near edge regions of the first glazing unit from said second area.

10. The glazing assembly according to claim 9, further comprising a first peripheral gasket secured between said first glass surface and the removable clamping parts of said plurality of glazing profiles.

11. The glazing assembly according to claim 10, further comprising a second peripheral gasket secured between said second glass surface and the mobile clamping portions of said plurality of glazing profiles.

12. The glazing assembly according to claim 9, wherein the removal of the mobile clamping portion from the structural frame portion for each of the main structural frame parts of said plurality of glazing profiles, unclamps said first glazing unit and opens a clearance allowing the removal of said first glazing unit in the direction of said second area by a rotation of said first glazing unit about an edge thereof, or by a translation in the direction of the second area, or by a combination of rotation and translation.

13. A curtain wall glazing system, comprising the glazing assembly of claim 1.

14. A glazing panel for an unitizing façade system, comprising glazing assembly according to claim 1.

15. A method for performing a maintenance activity near at least one edge region of a first glazing unit from a curtain wall glazing system that is separating a first area from a second area, and wherein said glazing system comprises a glazing assembly according to claim 1, said method comprising:

selecting whether the maintenance activity is to be performed from the first area or form the second area, if the maintenance activity is to be performed from the first area then a) for one or more of said plurality of glazing profiles uncoupling the clamping parts from the structural frame parts, thereby opening a clearance to said edge region, b) performing said maintenance activity from said first area, if the maintenance activity is to be performed from the second area then a) removing the mobile clamping portion from the structural portion for said at least one main structural frame part, thereby opening a clearance to said edge region, b) performing said maintenance activity from said second area.

16. The glazing assembly according to claim 1, wherein the mobile clamping portion is removable while the removable clamping part is coupled to the main structural frame part, and the removable clamping part is removable while the mobile clamping portion is coupled to the structural portion.

17. A glazing assembly for a curtain wall glazing system separating a first area from a second area, comprising:

a first glazing unit comprising a first glass surface for facing said first area and a second glass surface for facing said second area, a plurality of glazing profiles forming a frame structure for said first glazing unit, and wherein each glazing profile comprises a main structural frame part, and a removable clamping part removably coupled to the main structural frame part by a fastener, wherein said first glazing unit is clamped between the main structural frame parts and the removable clamping parts of said plurality of glazing profiles, with the first glass surface linked with the removable clamping part, and the second glass surface linked with the main structural frame part, wherein an uncoupling of the removable clamping parts from the corresponding main structural frame parts for each glazing profile unclamps the first glazing unit and opens a clearance allowing the removal of the first glazing unit in a direction of the first area, wherein at least one main structural frame part of said plurality of glazing profiles further comprises a structural portion, and a mobile clamping portion removably coupled by a fastener to said structural portion, and linked with the second glass surface, wherein the removal of the mobile clamping portion from the structural portion for said at least one main structural frame part, opens a clearance allowing maintenance activities to be performed near an edge region of the first glazing unit from said second area, and wherein the removal of the mobile clamping portion from the structural portion that opens the clearance allows access to an inner channel of the glazing profile.

18. The glazing assembly according to claim 17, wherein the fastener removably coupling the mobile clamping portion to the structural portion comprises screws or bolts.

19. The glazing assembly according to claim 17, wherein the fastener removably coupling the removable clamping part to the main structural frame part comprises screws.

* * * * *